US006096954A

United States Patent [19]

Hatfield

[11] Patent Number: 6,096,954

[45] Date of Patent: Aug. 1, 2000

[54] CAPO-HOLDING ACCESSORY FOR A STRINGED MUSICAL INSTRUMENT

[76] Inventor: Jack Hatfield, 325 Laurelwood Dr., Pigeon Forge, Tenn. 37863

[21] Appl. No.: 09/266,515

[22] Filed: Mar. 11, 1999

[51] Int. Cl.[7] ..... G10D 3/00

[52] U.S. Cl. ..... 84/329; 84/453; 84/318

[58] Field of Search ..... 84/329, 453, 318, 84/315; 248/228.7, 231.81

[56] References Cited

U.S. PATENT DOCUMENTS

| | | | |
|---|---|---|---|
| D. 270,918 | 10/1983 | Willaimson et al. | D17/3 |
| 3,722,346 | 3/1973 | Valentino | 84/318 |
| 3,823,247 | 7/1974 | Bauerfeind | 84/318 |
| 3,933,077 | 1/1976 | Dunlop | 84/318 |
| 4,270,432 | 6/1981 | Wilkerson | 84/318 |
| 4,823,670 | 4/1989 | Gherman et al. | 84/318 |
| 4,856,404 | 8/1989 | Hughes, Sr. | 84/297 |
| 5,623,110 | 4/1997 | Hoglund et al. | 84/318 |
| 6,013,868 | 1/2000 | Sims et al. | 84/318 |

*Primary Examiner*—Stanley J. Witkowski
*Assistant Examiner*—Kim Lockett
*Attorney, Agent, or Firm*—Michael E. McKee

[57] ABSTRACT

A capo-holding apparatus for a stringed musical instrument having a fingerboard along which the strings of the instrument extend and a peg head disposed at one end of the fingerboard includes a body which is securable against the peg head or some other part of the stringed instrument in a fixed position relative thereto. The body is, in turn, adapted to releasably hold a capo in fixed relationship relative to the body so that when the capo is held in a fixed relationship relative to the body and the body is secured in a fixed position relative to the stringed instrument, the capo is held in a fixed position relative to the stringed instrument.

20 Claims, 4 Drawing Sheets

CAPO-HOLDING ACCESSORY FOR A STRINGED MUSICAL INSTRUMENT

BACKGROUND OF THE INVENTION

This invention relates generally to musical instrument accessories and relates, more particularly, to an accessory for a stringed musical instrument with which a capo can be used.

A stringed musical instrument which accommodates the use of a capo (also known as a capotasto) has a fingerboard across which the capo can be secured for shortening the effective length of the strings and thereby altering the pitch of all of the strings of the instrument simultaneously. Examples of a stringed musical instrument with which a capo can be used include the guitar, the banjo and the mandolin.

It may be desirable, for example, during or between musical performances, that a musician attach a capo to his instrument as quickly as possible in order to be able to resume his performance as quickly as possible. Preferably, such an attachment can be effected with one hand alone (i.e. the fretting hand alone) since the other hand will commonly be preoccupied with a plectrum, or pick. To shorten the time needed before the performance can be resumed, it would be desirable if the capo were stored at a site which is readily accessible to the performer so that when needed, the capo can be readily located and retrieved by the performer for attachment to the instrument and wherein the retrieval and attachment can be affected with only one hand. Similarly, it would be desirable to provide such a storage site to which the capo can be quickly returned for storage when the capo is detached from the instrument. The provision of such a storage site would also reduce any likelihood that the performer will misplace and thereby lose his capo—which is small in size and can be easily lost.

Accordingly, it is an object of the present invention to provide a storage site adjacent the stringed instrument which serves as a depository from which a capo can be readily retrieved when needed and to which the capo can be readily returned when detached from the instrument.

Another object of the present invention is to provide such a storage site adjacent the instrument into which the capo can be stored to reduce any likelihood that the capo will be misplaced, lost or stolen.

Still another object of the present invention to provide a new and improved holding apparatus for holding a capo in close proximity to the stringed instrument with which the capo is used.

Yet another object of the present invention is to provide such a holding apparatus which is attachable to the stringed instrument in a manner which does not deface or otherwise damage the instrument when attached thereto.

Yet still another object of the present invention is to provide such a holding apparatus which does not permit the capo to be seen from the front of the instrument when held by the holding apparatus.

A further object of the present invention is to provide such a holding apparatus which is uncomplicated in construction yet effective in operation.

SUMMARY OF THE INVENTION

This invention resides in a capo-holding apparatus for a stringed musical instrument with which a capo can be used.

The apparatus includes a body which is securable in a fixed position relative to the stringed musical instrument, and the body is adapted to releasably hold a capo so that when the capo is held by the body and the body is secured in a fixed position relative to the stringed instrument, the capo is held in a fixed position relative to the stringed instrument.

DETAILED DESCRIPTION OF THE ILLUSTRATED EMBODIMENTS

Figure 1:
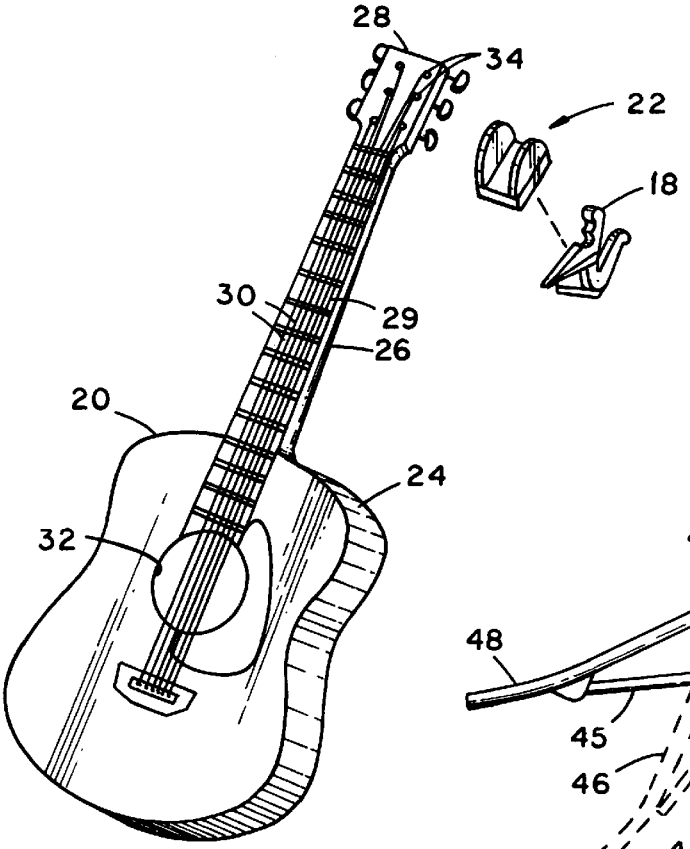
FIG. 1 is a perspective view of an embodiment of a capo-holding apparatus, a capo and a stringed instrument, shown before attachment to one another.

Turning now to the drawings in greater detail and considering first FIG. 1, there is shown a stringed musical instrument 20 to which an embodiment of a capo-holding apparatus, generally indicated 22, can be secured for the purpose of releasably securing a capo 18 (FIGS. 1 and 2) in a stationary position with respect to the stringed instrument 20. More specifically, the FIG. 1 instrument 20 is a six-string acoustic guitar having a body 24, a neck 26 joined to so as to extend from the body 24 and a peg head 28 joined to the neck 26 opposite the body 24. The strings, indicated 30, of the guitar 20 are anchored to the body 24 adjacent the guitar sound hole 32 and extend along the length of the neck 26 to the peg head 28 where the string ends are wound around pegs 34 secured within the peg head 28. The surface of the neck 26 disposed beneath the strings 30 provide the fingerboard 29 of the instrument 20.

Figure 3:
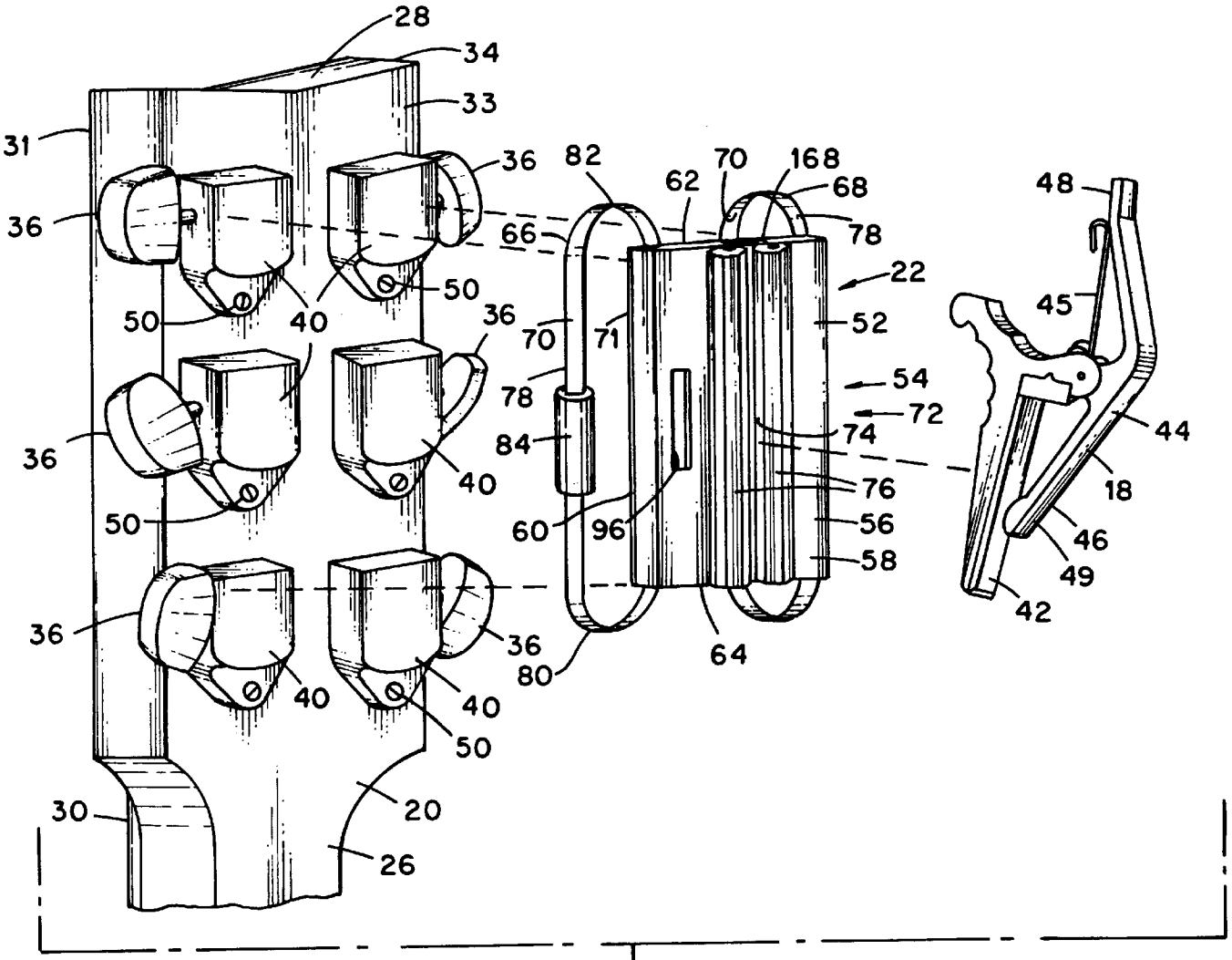
FIG. 3 is a fragmentary view of the FIG. 1 capo-holding apparatus, capo and stringed instrument, shown from a alternative perspective from that shown in FIG. 1 and drawn to a larger scale.

As best shown in FIG. 3, the peg head 28 has front and back surfaces 31 and 33, respectively, and each peg 34 (FIG. 1) extends between the front and back surfaces 31 and 33 through a corresponding bore provided in the peg head 28. The pegs 34 are attached with suitable gears to tuning keys 36 (FIG. 3) disposed adjacent the back surface 33 of the peg head 28 so that by manually turning the keys 36, the tension of the strings 30 is adjusted. To this end, the gears which join the tuning keys 36 to the pegs 34 are mounted on the back surface 33 of the peg head 28 and are commonly covered with caps 40 which, in turn, are held in place with headed screws 50. Each tuning key 36 extends to one side of a corresponding cap 40 so as to be disposed to one side of the peg head 28. In the depicted six-string guitar 20, three keys 36 extend to one side of the peg head 28 while the remaining three keys 36 extend to the other side of the peg head 28. As will be apparent herein, other musical instruments, notably banjos, employ tuning keys which are coupled to a planetary or offset "straight through" type of gear wherein the tuning keys protrude rearwardly, rather than to one side, of the instrument peg head, and the holding apparatus 22 described herein can be used to hold a capo against an instrument with tuning keys having this orientation.

Figure 2:
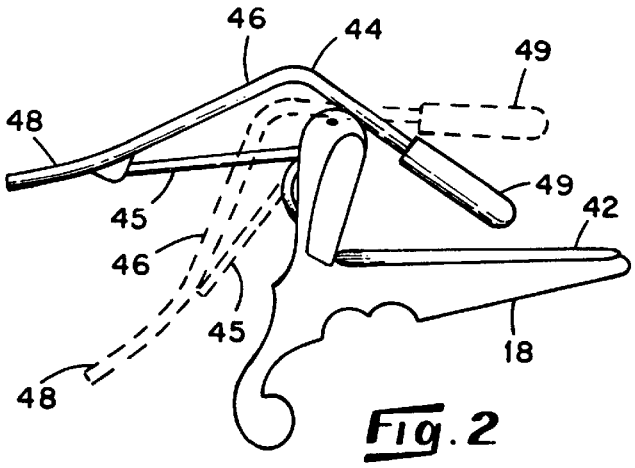
FIG. 2 is a front elevational view of the capo illustrated in FIG. 1 and drawn to a slightly larger scale.

As best shown in FIG. 2, the capo 18 which is capable of being held by the FIG. 1 holding apparatus 22 has a padded bar 42 which is positionable across the strings 30 of the instrument 20 and a clamping portion 44 for holding the bar 42 tightly against the fingerboard 29 of the instrument 20. The general construction and function of the capo 18 is well known in the art so that a detailed description thereof is not believed to be necessary. Suffice it to say, however, that the bar 42 and clamping portion 44 can be manipulated (e.g. opened) so as to accept the neck 26 of the instrument 20 when inserted sidewise therein, and by securing the clamping portion 44 in place so that the bar 42 urges the strings 30 against the fingerboard 29, the length of the strings 30 are effectively shortened. Therefore, the capo 18 provides a means by which the pitch of all of the strings of the instrument can be altered simultaneously. In the depicted capo embodiment 18, the clamping portion 44 has a spring-biased lever 46 (having an effort arm portion 48 and a response arm portion 49) which is pivotally attached to the bar 42 so that by appropriately moving the effort arm portion 48 to an open condition, illustrated in phantom in FIG. 2, the response arm portion 49 and bar 42 are spaced a sufficient distance apart to accept the instrument neck 26. By manipulating the effort arm portion 48 so that the capo opens to an opened condition and directing the capo 18, when in its opened condition, about the instrument neck 26 so that the bar 42 spans the strings 30 and fingerboard 29 and then releasing the effort arm portion of the lever 46, the response arm portion 49 is spring-biased (by means of a spring 45) toward a closed condition, illustrated in solid lines in FIG. 2, so that the bar 42 urges the strings 30 against the instrument fingerboard 29. A capo which corresponds to the foregoing description is available from the Kyser Musical Products, of Arlington, Tex. under the trade designation Quick-Change Capo. Other styles of capos are known and available, but each capo style includes a bar for spanning the instrument fingerboard.

With reference again to FIG. 3, the depicted capo-holding apparatus 22 includes a rigid body 52 to which the capo 18 can be releasably secured and securement means, generally indicated 54, for securing the body 52 to the peg head 28. The body 52 of the depicted apparatus 22 is in the form of an elongated, platen-like block 56 comprised of a material, such as a hard plastic, having a front 58, a back 60 and two opposite ends 62 and 64. As will be apparent herein, when the body 52 is secured to the peg head 28, the back 60 of the body 52 rests against the gear caps 40. (If the apparatus 22 is attached about the tuning keys of the "straight through" type, such as those of a banjo, the body 52 rests directly against the back surface of the peg head.) Consequently, the back 60 of the body 52 is preferably smooth so that the surfaces of the gear caps 40 (or the peg head) are not scratched or otherwise damaged by the body 52. If desired, a layer 71 of soft elastomeric material can be adhesively secured to the back of the block 56 to pad the body 52. Furthermore, at least one pick-accepting slot 96 can be formed within the front surface 58 of the block 56 enabling a musician to store a pick therein.

Figure 4:
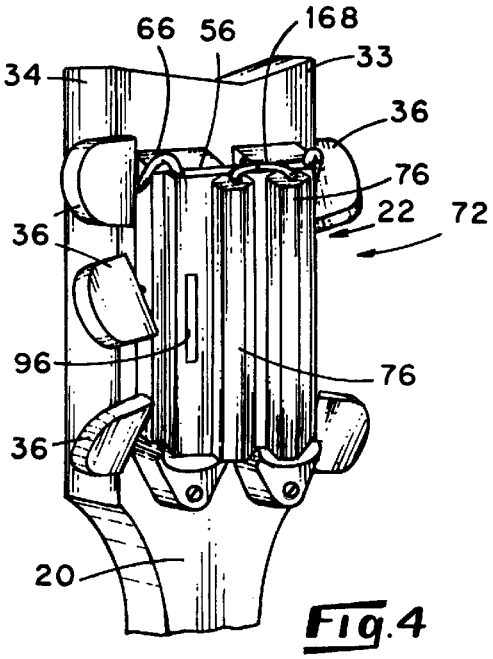
FIG. 4 is a fragmentary perspective view of the FIG. 1 capo-holding apparatus and stringed instrument, shown attached to one another.
Figure 5:
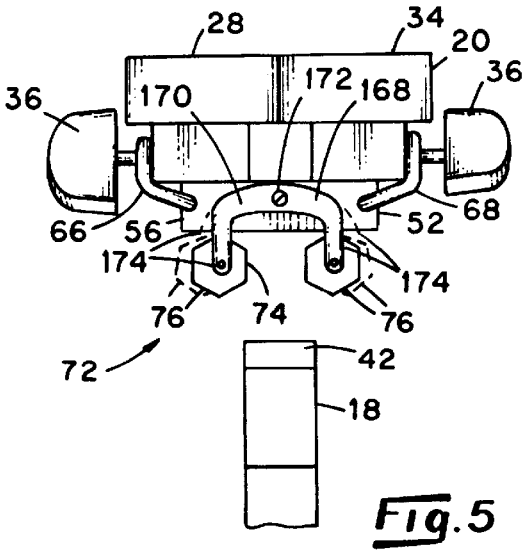
FIG. 5 is a plan view of the holding apparatus and instrument of FIG. 1 as viewed generally from above in FIG. 4 and a fragment of the FIG. 1 capo shown before attachment to the holding apparatus.

The securement means 54 includes a pair of straps 66, 68 which are fixedly joined to the body 52 so as to provide identical loops 70 which are securable about the tuning keys 36 disposed on opposite sides of the peg head 28. To this end, each strap 66 or 68 is disposed along opposite side edges of the body 52 and its opposite ends are fixedly secured, e.g. embedded within or riveted to, the body 52 adjacent the ends 62, 64 thereof. Each strap 66, 68 of the depicted embodiment is in the form of a cord or cable 78 having securable portions 80, 82 having ends which are joined together with an internally-threaded sleeve-like connector member 84. Therefore, by positioning the back surface 60 of the block 56 against the back of the peg head 28, or against the gear caps 40, and then looping and securing the cables 78 about the keys 36, or in particular the shanks of the keys 36, the body 52 is held in a fixed relationship relative to the peg head 28 as shown in FIGS. 4 and 5. The tightness of the cables 78 about the keys 36 can be adjusted by rotating the connector member 84 in an appropriate direction.

With reference to FIGS. 3–5, the apparatus 22 also includes means, generally indicated 72, associated with the body 52 for releasably holding the capo 18 in fixed position relative to the body 52. To this end, the holding means 72 includes means providing a recess 74 having an outward-directed opening for accepting and holding a portion, e.g. the elongated bar 42, of the capo 18 when that portion is inserted into the recess 74. To this end, the recess-providing means 72 includes a pair of padded rollers 76 which are positioned adjacent the front 58 of the body 52 and which are arranged in spaced and parallel relationship with one another to provide the recess 74 therebetween. The depicted rollers 76 are sextagonal in shape, i.e. with six side surfaces, but could possess an alternative shape, such as a pentagonal or cylindrical shape. The flat surfaces provided by non-cylindrical surfaces of the rollers are preferable over the rounded surfaces provided by cylindrical roller surfaces in that the flat surfaces provide greater roller surface-to-capo contact when the capo is positioned between the rollers thereby increasing the security of the capo when held between these non-cylindrical rollers.

Furthermore, a pair of U-shaped springs 168 (FIGS. 3 and 5) are attached to each end 62 and 64 of the body 52 and to the ends of the rollers 76 so that the rollers 76 are supported in the aforedescribed spaced relationship. More specifically, and as best shown in FIG. 5, each U-shaped spring 168 has a base 170 which is fixedly attached, as with a screw 172, to a corresponding end 62 or 64 of the body 52 and a pair of legs 174 which are connected to an end of a corresponding roller 76.

Due to the resilient nature of the springs 168, the rollers 76 are biased from an open condition, as illustrated in phantom in FIG. 5, at which the rollers 76 are spaced a short distance apart toward a closed condition, as illustrated in solid lines in FIG. 5, at which the rollers 76 are positioned closer together. When in a closed condition, the rollers 76 are spaced apart by a distance which is slightly smaller than the thickness of the capo bar 42 so that by manually urging the bar 42 of the capo 18 between the rollers 76 and subsequently letting go of the capo 18, the bar 42, and thus the capo 18, is held between the rollers 76 in a clamped condition. Preferably, the rollers 76 are spaced from the front surface 58 of the body 52 by an amount sufficient to accommodate the positioning of the bar 42 against the front surface 58 of the body 52 so that the capo bar 42 is thereby clamped in a snap-fit relationship against the front surface 58 of the body 52 as the rollers 76 are urged by the springs 168 toward the closed condition.

It follows that when the holding apparatus 22 is secured to the back, or the back side, of the peg head 28 of the instrument 20 as aforedescribed, the holding apparatus 22 provides a convenient site at which a musician who is playing the instrument 20 can readily store the capo 18 and can readily detach the capo from the apparatus 22 for use of the capo 18. Since capos are small in size, the storage site provided by the apparatus keeps the capo in the vicinity of the instrument 20 and thereby reduces any likelihood that the capo will be misplaced and become lost. Furthermore, the proximity of the provided storage site to the fingerboard 29 accommodates the insertion of the capo 18 into or removal of the capo 18 from the apparatus 22 with a single hand, i.e. the same hands which frets the instrument 20. By effecting the movement of the capo 18 between the holding apparatus 22 and the instrument neck 26 (and vice-versa) with a single, i.e. fretting, hand, the other hand, which is likely to be holding a pick, is not needed for purposes of moving the capo 18 between the apparatus 22 and the neck 26. Further still and since the capo 18 is held adjacent the back side of the peg head 28 when secured to the apparatus 22, the stored capo 18 cannot be seen from the front of the instrument 20 and is thereby hidden from view from an audience situated in front of the instrument 20. Moreover, because the holding apparatus 22 can be secured to the back of the peg head 28 without the need for screws or other fasteners which could permanently deface the instrument 20, the holding apparatus 22 is further advantageous in this respect.

Figure 6:
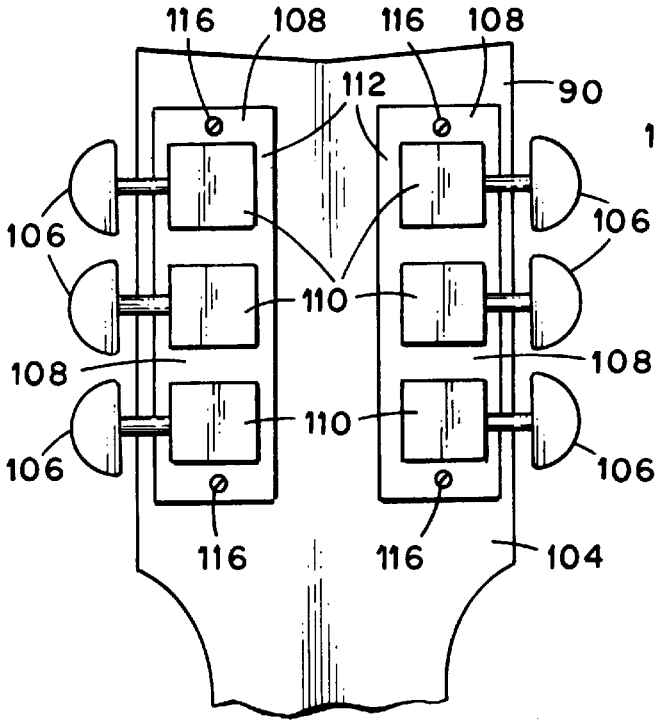
FIG. 6 is a back elevational view of the peg head of an alternative instrument to which another embodiment of a capo-holding apparatus can be attached.
Figure 7:
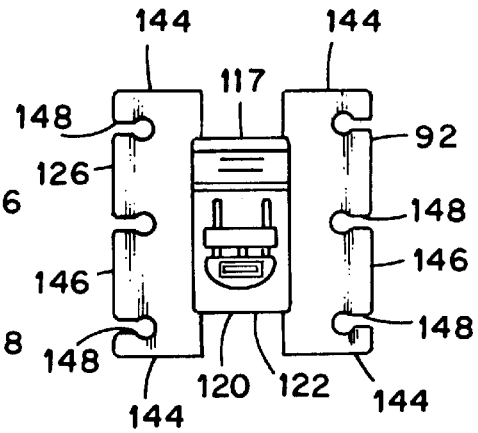
FIG. 7 is a front elevational view of another embodiment of a capo-holding apparatus capable of being secured to the peg head of the instrument of FIG. 6.

With reference to FIGS. 6 and 7, there is shown an alternative peg head design for a stringed instrument 90 (FIG. 6) and an alternative embodiment of a capo-holding apparatus 92 (FIG. 7) which is capable of being attached to the instrument 90 for purposes of holding a capo 94 (FIG. 9) in a fixed position relative to the peg head of the instrument 90. The depicted stringed instrument 90 has a peg head 104 whose tuning keys 106 are attached thereto by way of a pair of detachable gear assemblies 108. Each of these detachable gear assemblies 108 include a plurality of gear sets 110 which are joined together by way of a common face plate 112, and each tuning key 106 is joined to a corresponding gear set 110 so as to extend generally to one side of the assembly 108.

Figure 8:
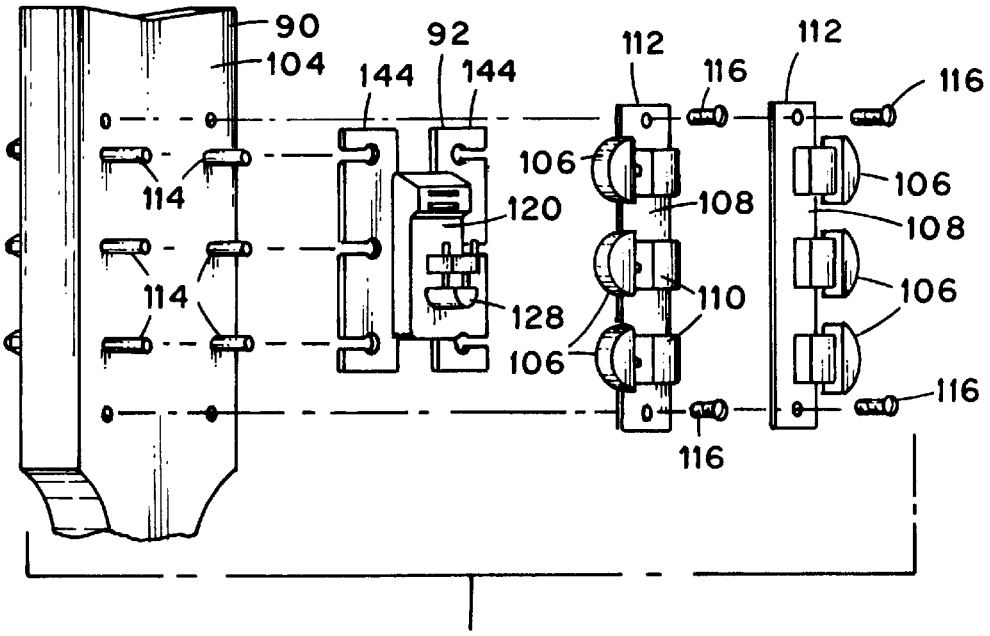
FIG. 8 is an exploded perspective view of the instrument of FIG. 6 and the holding apparatus of FIG. 7, demonstrating the attachment of the holding apparatus to the FIG. 6 instrument.

As best shown in FIG. 8, the peg head 104 of the stringed instrument 90 (which in this case is a six-string guitar) has two rows of openings through which the pegs 114 extend, and each gear assembly 108 is positionable against the rear surface of the peg head 104 so that the portion of the pegs 114 (or, in particular, the shafts of the pegs) which extend through the peg head cooperatively interfit with the gears of the gear sets 110. Thus, by rotating the tuning keys 106, the corresponding peg 114 is rotated within its peg head opening by a corresponding amount. Each gear assembly 108 is fixed to the peg head 104 with headed screws 116 which extend through the face plate 110 and into rear surface of the peg head 104.

Figure 9:
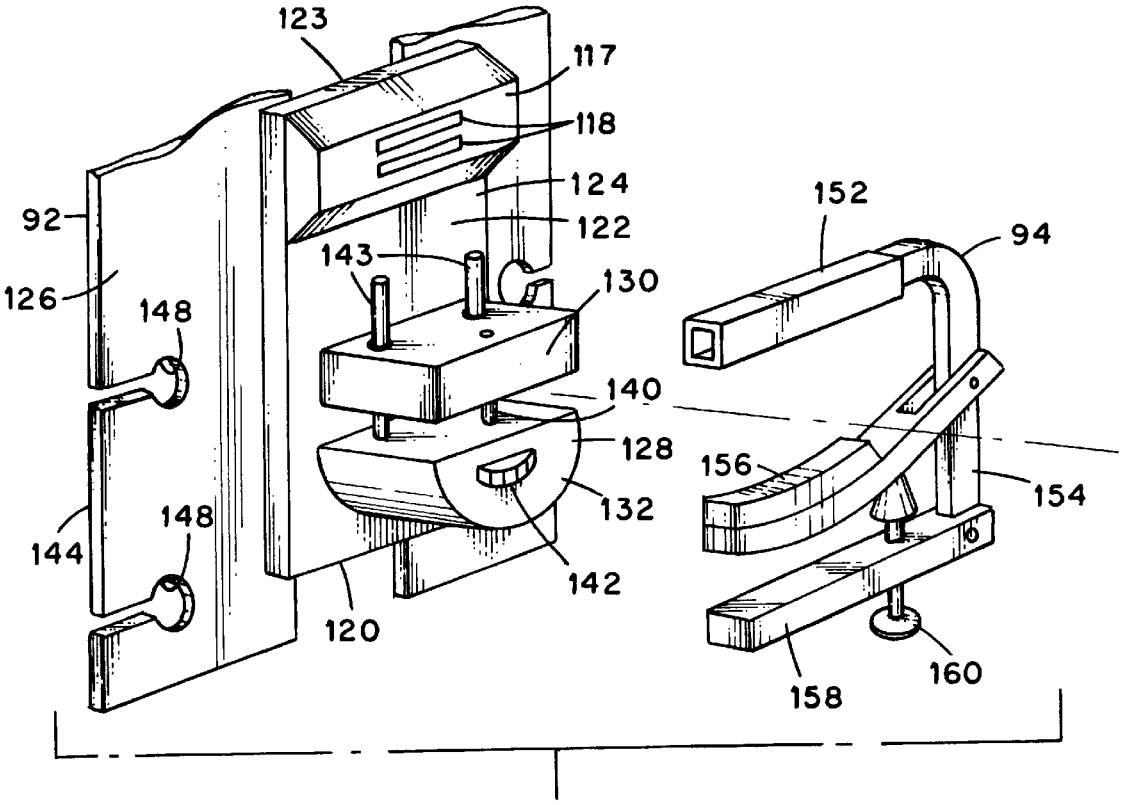
FIG. 9 is an exploded perspective view of the capo-holding apparatus of FIG. 8 and a capo capable of being secured about the holding apparatus.

With reference to FIGS. 7–9, the capo-holding embodiment 92 includes a body 120 to which the capo 94 is securable and a securement portion 126 for securing the body 120 to the peg head 104. In the depicted embodiment 92, the body 120 includes a plate-like block 122 having back and front surfaces 123, 124, respectively, and an adjustable assembly 128 attached to the block 122. The block 122 is provided with an upper end portion 117 of increased thickness, and one or more pick-accepting slots 118 are defined within this upper end portion 117 for storing picks (not shown) for the musician.

The adjustable assembly 128 provides a mechanism having two (upper and lower) sections 130, 132 about which the capo 94 can be clamped. The lower section 132 of the assembly 128 has a rounded bottom surface and is fixedly secured, as with glue, to the front surface 124 of the block 122, and the upper section 130 of the assembly 128 is secured to the lower section 132 for movement toward and away from the lower section 132. To this end, an adjustment screw 140 (having a rotatable knob 142) is mounted for rotation within the lower section 132 and is threadably received within the underside of the upper section 130 so that by rotating the screw 140 by way of the knob 142, the upper section 130 is moved toward or away from the lower section 132 by a corresponding amount to accommodate capos of different sizes or having a different scheme of attachment about the instrument neck. The assembly 128 also includes a pair of guide pins 143 which are secured within the lower section 132 and are accepted by through-holes provided in the upper section 130 so that as the upper section 130 is moved toward and away from the lower section 132, its movement is guided along the guide pins 143.

The securement portion 126 of the holding embodiment 92 includes a pair of backing plates 144 to which the block 122 is secured, as with glue, and which is adapted to be secured to the peg head 104 as the backing plates 144 are sandwiched between the back surface of the peg head 104 and the face plates 112 of the gear assemblies 108. (This same attachment scheme can be used to secure the holding embodiment 92 to a stringed instrument whose peg head employs individual, or separate gear assemblies.) To this end and as best shown in FIGS. 7 and 8, each backing plate 144 has side edges 146 which are appropriately notched with cutouts 148 for accepting the shanks of the pegs 114 when the side edge 146 of each backing plate 144 is inserted into place between the back surface of the peg head 104 and the face plate 112 so that the pegs 114 are accepted within the cutouts 148. If desired, the notches can be made to accept the shafts of the pegs of instruments whose spacing is different from those of the depicted instrument by incorporating within the backing plate 144 a cutout-bearing insert which can be rotated relative to the remainder of the plate 144 to alter the spacing between adjacent cutouts.

To secure the holding embodiment 92 into place, the screws 116 are loosened (or removed) from the face plates 112 and the face plates 112 are pulled away from the back surface of the peg head 104 to expose the shafts of the pegs 114. Each backing plate 144 of the holding apparatus 92 is then manipulated into place along the back surface of the peg head 104 so that the pegs 114 are accepted by the cutouts 148. In this connection, the backing plates 144 are preferably constructed out of a flexible plastic material which facilitates the maneuvering of the backing plates 144 into place. With the holding apparatus 92 held in place about the pegs 114, the gear assemblies 108 are repositioned over the pegs 114 and the face plates 112 are then re-secured to the peg head 104 with the headed screws 116. The holding apparatus 92 is thereby fixed in position against the peg head 104 as the backing plates 144 are sandwiched between the back surface of the peg head 104 and the face plates 112 and held against the peg head 104 by the heads of the screws 116.

The cross-sectional shape of the periphery of the upper and lower sections 130, 132 of the adjustable assembly 128 simulates the cross-sectional shape of the periphery of the neck of the stringed instrument 90 so that the capo 94 can be secured about the upper and lower sections 130, 132 as it is ordinarily secured about the instrument neck when the capo 94 is in use or, more specifically, when the capo 94 is secured across the strings of the instrument 90. To this end, the capo 94 depicted in FIG. 9 includes an elongated padded bar 152 adapted to rest across the strings of the instrument 90 and a clamping mechanism 154 positionable on the underside of the instrument neck for urging the bar 152 against the strings. The clamping mechanism 154 includes an arcuate back piece 156 which is positionable against the underside of the instrument neck and a lever 158 having a set screw 160 which is positionable against the back piece 156 when the capo 94 is used on the instrument. By positioning the bar 152 across the instrument strings, positioning the arcuate back piece 156 against the back of the neck and then pivoting the lever 158 toward the back piece 156 so that the set screw 160 engages the back piece 156, the clamping mechanism 154 operates as an over-center locking arrangement which prevents the back piece 156 from coming away from the instrument neck. A capo of the foregoing description is available from the Shubb Company of Valley Ford, Calif. Another capo, which is comparable to the capo 94 in the sense that it has an adjustment mechanism is normally adjusted to fit an instrument neck of a particular size, is available from Kyser Musical Products, Arlington, Tex. under the trade designation Paige Capo.

Since the rounded periphery of the adjustable assembly 128 of the holder apparatus simulates the rounded periphery of the neck of the instrument 90, the capo 94 is securable about the assembly 128 in the manner in which the capo 94 is securable about the instrument neck when the capo is in use. More specifically, by positioning the bar 152 across the top of the upper section 130, positioning the back piece 156 against the underside of the lower section 132 and then pivoting the lever 158 toward the back piece 156 so that the set screw 160 engages the back piece 156 in an over-center locking arrangement, the clamping mechanism 154 locks the capo 94 in position about the assembly 128. The adjustable assembly 128 can be increased or decreased in size (to simulate a larger or smaller instrument neck) by rotating the knob 142 of the adjustment screw 140 in an appropriate direction.

Figure 10:
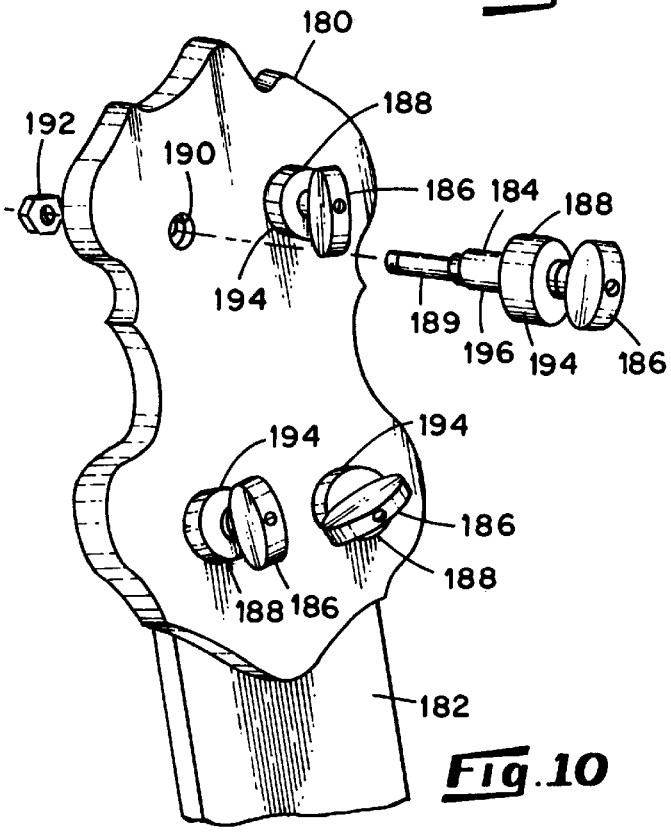
FIG. 10 is a perspective view of a peg head of another stringed instrument to which a capo-holding apparatus can be attached.

As mentioned earlier, there exist stringed instruments, notably banjos, which employ tuning keys which are coupled to a planetary or offset "straight through" type of gear wherein the tuning keys protrude rearwardly, rather than to one side, of the instrument peg head. For example, there is illustrated in FIG. 10 the peg head 180 of a banjo 182 having four pegs 184 (only one shown) which are each coupled to a tuning key 186 by way of a "straight through" type of gear assembly 188. This assembly 188 is a unitary structure including a peg-including forward portion having a shaft 189 which is insertable through a bore 190 formed in the peg head 180 and is securable therein by way of a nut 192. Each assembly 188 also includes an aligned shoulder portion 196 and an enlarged rearward portion 194 within which the gears of the assembly 188 are housed, and the tuning key 186 is attached to the gears of the assembly 188 so as to extend rearwardly of the peg head 180 along a path which is coincident with the longitudinal axis of the peg shaft 189.

Figure 11:
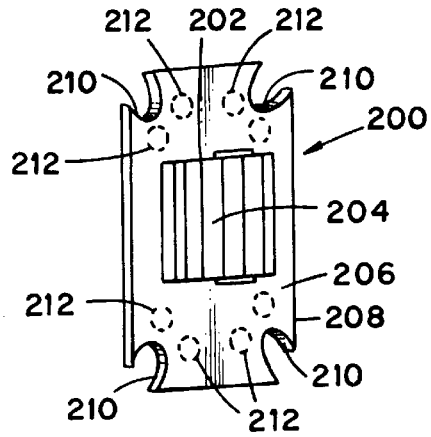
FIG. 11 is a perspective view of an embodiment of a capo-holding apparatus which can be secured to the peg head of the instrument of FIG. 10.

A holding apparatus embodiment can also be constructed which is securable to the peg head 180 by way of the gear assemblies 188. For example, there is illustrated in FIG. 11 still another embodiment, generally indicated 200, of a holding apparatus which can be secured to the peg head 180 of the FIG. 10 instrument by way of the gear assemblies 188. To this end, the apparatus 200 includes a block-like body 202 to which a pair of spaced rollers 204 are secured, as the rollers 76 of the holding embodiment 22 of FIGS. 1 and 3–5 are secured to the block-like body 56 thereof, and a backing plate 206 is fixedly secured, as with glue, to the back of the block-like body 202. The plate 206 is provided with corner notches 210 and is sized to be positioned between the enlarged rearward portions 194 of the gear assemblies 188 and the rear surface of the peg head 180 while the openings in the corner notches 210 are positioned in registry with the peg openings 190 for accepting the peg shoulder portions 196. In other words, by loosening the nuts 192 which hold the gear assemblies 188 in place and pulling the enlarged portions 194 away from the surface of the peg head 180 by a short distance, the edges 208 of the plate 206 can be manipulated, or slid, between the peg head surface and the enlarged portions 194 while the corner notches 210 accept the peg shoulder portions 196. By subsequently re-tightening the nuts 192, the plate 206 is thereby fixed against the rear surface of the peg head 180 as the side edges 208 of the plate 206 are sandwiched between the gear assemblies 188 and the peg head 180. In addition to or instead of the corner notches 210, the backing plate 206 can be provided with removable knockouts 212 which accommodate the use of the holding apparatus 200 with a peg head whose pegs are spaced apart by alternative distances.

It follows from the foregoing that a capo-holding apparatus has been described which is attachable to a stringed instrument for providing a convenient storage site for a capo and which accommodates the movement of the capo between the storage site for storage and a condition of use about the instrument neck with a single hand. Moreover, since the capo-holding apparatus is securable to the peg head of the stringed instrument for the purpose of holding the capo adjacent the back side of the peg head, a capo which is attached to the holding apparatus cannot be seen from the front of the instrument and is therefore hidden from view from an audience situated in front of the instrument. Further still, the holding apparatus is attachable to the peg head with securement means which do not deface or damage the stringed instrument.

It will be understood that numerous modifications and substitutions can be had to the aforedescribed embodiments without departing from the spirit of the invention. For example, although the straps 66, 68 of the securement means 54 of the aforedescribed holding embodiment 22 of FIGS. 1–5 have been shown and described being in the form of cables, each strap can be constructed of an elastomeric material, such as rubber. To secure such straps to the peg head 28, the straps are stretched over the keys 36 and subsequently released so that the straps tighten about the keys 36 (or, in particular, the shanks of the keys 36) and thereby hold the body 52 in a fixed position relative to the peg head 28. Further still, alternative embodiments of this invention can be attached to stringed instruments by alternative securing means, such as with suction cups or contact adhesive (e.g. glue), and can be adapted to be secured to parts of the stringed instrument other than the peg head, such as to the back or sides, of the instrument.

Accordingly, the aforedescribed embodiments are intended for the purpose of illustration and not as limitation.

What is claimed is:

1. A capo-holding apparatus for a stringed instrument with which a capo can be used and wherein the capo includes a bar for engaging the strings of the instrument and means for securing the bar across the strings of the instrument, the apparatus comprising:

a body which is securable to the stringed musical instrument in a fixed position relative thereto, and the body includes means for releasably holding a capo when the capo is not in use so that when the capo is not in use and is held by the body and the body is secured in a fixed position relative to the stringed musical instrument, the capo is held in a fixed position relative to the stringed musical instrument.

2. The apparatus as defined in claim 1 wherein the body includes means providing a recess f or accepting a portion of the capo inserted within the recess so that when the portion of the capo is inserted within the recess, the capo is releasably held in a fixed position relative to the body by the recess-providing means.

3. The apparatus as defined in claim 2 wherein the recess has an opening through which a portion of the capo is insertable so that by inserting the portion of the capo through the opening of the recess, the capo portion is held in fixed relationship relative to the body.

4. The apparatus as defined in claim 2 wherein the recess-providing means is adapted to hold the portion of the capo in snap-fit relationship when accepted by the recess of the recess-providing means.

5. The apparatus as defined in claim 3 wherein the recess-providing means includes a pair of spaced rollers between which the portion of the capo is insertable and means for biasing the rollers toward one another so that when the portion of the capo is inserted between the rollers so that the rollers are forced further apart, the capo is held by the recess-providing means as the inserted portion of the capo is pressed between the rollers.

6. The apparatus as defined in claim 5 wherein the spaced rollers have flat peripheral surfaces so that when a portion of the capo is positioned between the rollers, the flat peripheral surfaces provide a relatively large amount of surface-to-surface contact between the rollers and the capo.

7. The apparatus as defined in claim 1 wherein the stringed musical instrument with which the capo is used includes a fingerboard along which the strings of the instrument extend and a neck along which the fingerboard extends, and the body includes a mechanism having a periphery whose cross-sectional shape simulates the cross-sectional shape of the periphery of the instrument neck so that the capo can be secured to the portion of the body in a manner comparable to the manner in which the capo is securable about the neck of the stringed musical instrument.

8. The apparatus as defined in claim 1 wherein the apparatus includes means for releasably securing the body in a fixed relationship relative to the stringed musical instrument.

9. The apparatus as defined in claim 8 wherein the stringed musical instrument with which the apparatus is used includes a fingerboard along which the strings of the instrument extend, a peg head disposed at one end of the fingerboard, and tuning keys which are associated with the peg head, and the means for releasably securing includes means attached to the body which are securable about the tuning keys for fastening the body to the peg head in a stationary relationship therewith.

10. The apparatus as defined in claim 9 wherein the fastening means includes straps which can be secured about the tuning keys of the stringed musical instrument for securing the body in stationary relationship therewith.

11. The apparatus as defined in claim 8 wherein the tuning keys of the stringed musical instrument are attached to the peg head by way of headed screws, and the fastening means includes a plate which is fastenable to the peg head by way of the headed screws as the plate is sandwiched between the peg head and the heads of the screws.

12. The apparatus as defined in claim 11 wherein the stringed instrument includes gears interposed between the tuning keys and the peg head, and the securing means is securable to the peg head by securing the plate between the peg head and the gears.

13. A capo-holding accessory for a stringed musical instrument having a fingerboard along which the strings of the instrument extend and a peg head disposed at one end of the fingerboard, and wherein the capo capable of being held by the accessory includes a bar for engaging the strings of the instrument and means for securing the bar across the strings of the instrument, the accessory comprising:

a body to which a capo can be releasably attached when the capo is not is use; and means joined to the body for releasably securing the body to the peg head of the stringed musical instrument so that the body is thereby releasably connected to the stringed musical instrument so that by attaching the capo to the body when the capo is not in use, the capo is releasably secured to the stringed musical instrument.

14. The apparatus as defined in claim 13 wherein the body includes means providing a recess for accepting a portion of the capo inserted within the recess so that when the portion of the capo is inserted within the recess, the capo is releasably held in a fixed position relative to the body by the recess-providing means.

15. The apparatus as defined in claim 14 wherein the recess has an opening through which a portion of the capo is insertable so that by inserting the portion of the capo through the opening of the recess, the recess-providing means cooperates to hold the capo portion in a snap-fit, fixed relationship relative to the body.

16. The apparatus as defined in claim 15 wherein the recess-providing means includes a pair of spaced rollers between which the portion of the capo is insertable and means for spring-biasing the rollers toward one another so that when the portion of the capo is inserted between the rollers so that the rollers are forced further apart, the capo is held by the recess-providing means as the rollers press against the opposite sides of the inserted portion of the capo.

17. The apparatus as defined in claim 13 wherein the stringed musical instrument with which the capo is used includes a neck along which the fingerboard extends, and the body includes a mechanism having a periphery whose cross-sectional shape simulates the cross-sectional shape of the periphery of the instrument neck so that the capo can be secured to the portion of the body in a manner comparable to the manner in which the capo is securable about the neck of the instrument when the capo is use.

18. The apparatus as defined in claim 13 wherein the stringed musical instrument with which the apparatus is used includes tuning keys and means for mounting the tuning keys upon the peg head, and the means for releasably securing includes means which are attachable to the peg head by way of the means for mounting the tuning keys upon the peg head.

19. In combination with a stringed musical instrument having a fingerboard along which the strings of the instrument extend and a peg head disposed at one end of the fingerboard, a capo-holding accessory for holding a capo having a string-engaging bar and means for securing the bar across the strings of the instrument, the accessory comprising:

a body to which a capo can be releasably attached when the capo is not in use; and means joined to the body for releasably securing the body to the stringed musical instrument so that the body is thereby releasably connected to the stringed musical instrument so that by attaching the capo to the body when the capo is not in use, the capo is releasably secured to the stringed musical instrument.

20. The combination of claim 19 wherein the peg head of the stringed musical instrument has a back side and the means for releasably securing is securable to the peg head so that when the capo is attached to the peg head, the capo is held on the back side of the peg head.

* * * * *